US006810609B2

(12) United States Patent
Lassonde et al.

(10) Patent No.: US 6,810,609 B2
(45) Date of Patent: Nov. 2, 2004

(54) SNOW GROOMER HAVING AN IMPROVED VARIABLE GEOMETRY TILLER ASSEMBLY

(75) Inventors: Jean-Philippe Lassonde, Granby (CA); Michel Pelletier, Canton de Shefford (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/168,155

(22) PCT Filed: Dec. 15, 2000

(86) PCT No.: PCT/CA00/01501

§ 371 (c)(1),
(2), (4) Date: Sep. 5, 2002

(87) PCT Pub. No.: WO01/44582

PCT Pub. Date: Jun. 21, 2001

(65) Prior Publication Data

US 2003/0051376 A1 Mar. 20, 2003

Related U.S. Application Data

(60) Provisional application No. 60/172,157, filed on Dec. 17, 1999.

(51) Int. Cl.[7] ..... E01H 5/04; E01H 5/09

(52) U.S. Cl. ..... 37/236; 37/245; 37/247; 172/123

(58) Field of Search ..... 37/234

(56) References Cited

U.S. PATENT DOCUMENTS

| | | | | | |
|---|---|---|---|---|---|
| 2,911,734 | A | * | 11/1959 | Sublett et al. | 37/104 |
| 3,572,444 | A | * | 3/1971 | Scholl et al. | 172/4.5 |
| 3,746,101 | A | * | 7/1973 | Takata | 172/112 |
| 4,348,825 | A | * | 9/1982 | Bachler | 37/222 |
| 4,523,398 | A | * | 6/1985 | Scheibel et al. | 37/220 |
| 4,726,129 | A | | 2/1988 | Haug | |
| 4,892,154 | A | * | 1/1990 | Ranner | 172/72 |
| 5,067,263 | A | | 11/1991 | Pelletier | |
| 5,067,264 | A | * | 11/1991 | Beeley | 37/222 |
| 5,142,800 | A | | 9/1992 | Hales et al. | |
| 5,265,949 | A | | 11/1993 | Haug | |
| 5,632,106 | A | | 5/1997 | Sinykin | |
| 5,659,984 | A | | 8/1997 | Haug | |
| 5,761,095 | A | | 6/1998 | Warren | |
| 5,809,671 | A | * | 9/1998 | Sinykin | 37/219 |
| 6,351,899 | B1 | * | 3/2002 | Slutzky | 37/223 |
| 6,354,023 | B1 | * | 3/2002 | Trahan et al. | 37/219 |

FOREIGN PATENT DOCUMENTS

EP 0 287 897 A 10/1988

* cited by examiner

*Primary Examiner*—Thomas B. Will
*Assistant Examiner*—Thomas A Beach
(74) *Attorney, Agent, or Firm*—Pillsbury Winthrop LLP

(57) ABSTRACT

A snow tiller (10) suitable for grooming ski hills, trails, or other areas, provides an adjustable profile tiller assembly. The snow tiller (10) is preferably pulled by a tracked vehicle (12) and has a tiller assembly formed of a plurality of tiller subassemblies (56,58). By varying the respective orientation of the tiller subassemblies (56,58), the snow tiller (10) can selectively provide coactive, level, convex, or more complex snow profiles depending upon the tiller configuration, snow conditions, and the intended uses. The snow tiller (10) also provides a control system to substantially maintain a selected snow profile while selectively permitting individual tiller subassemblies to float, thereby reducing the possibility of damage. The assembly can simultaneously provide an automatic release mode to protect the equipment from damage.

15 Claims, 8 Drawing Sheets

SNOW GROOMER HAVING AN IMPROVED VARIABLE GEOMETRY TILLER ASSEMBLY

This application claims the benefit of Provisional application No. 60/172,157, filed Dec. 17, 1999.

FIELD OF INVENTION

This invention relates to ground working devices, particularly snow grooming devices. More specifically, this invention relates to tillers for use with snow grooming vehicles for ski slopes.

BACKGROUND OF THE INVENTION

Ground working devices have long been used in agriculture to break up and till earth. Such devices, known as tillers, typically include a trailing assembly that has a rotating ground loosening unit and a smoothing or leveling board. The loosening unit can be subdivided into subassemblies connected by joint(s) to accommodate the changing contours of the ground.

This general concept has been adopted and modified to groom snow, especially ski slopes. Snow making and snow grooming has become an essential part of any successful ski center due to increased skier traffic, longer ski seasons, and variable weather conditions. As a result, snow groomers are becoming more sophisticated. Typical snow grooming vehicles are tracked vehicles, which provide traction across the snow and up and down hills. These vehicles are equipped with a number of attachments or devices to help in the snow grooming process.

Generally, a tracked snow vehicle has an inverted V-shaped or U-shaped plow on the front of the vehicle that collects snow from areas where there is too much and moves it to areas which are worn. The front implement can also rip up icy and encrusted slopes to create or renew trails and remove glacier surface ice. The front implement can include a toothed bar that is lowered by a pivoting ram to break up hard, icy slopes into large lumps. The tracks of the vehicle assist in breaking up the lumps. Attached to the rear of the vehicle is a snow tiller that grinds the lumps and surface and then smoothes the surface of the snow to restore it to skiing condition.

Snow tillers are frequently equipped with a drum formed as a rotating blade and a finishing member that trails behind the rotor. A snow chamber is formed immediately behind the drum under and behind the finishing member to hold a volume of snow so that it can be worked more extensively by the tiller. Variations in volume and configuration of the snow chamber can be provided during operation of the snow groomer according to U.S. Pat. No. 5,067,263, to provide additional control over the tiller performance. The finishing member is usually a flexible mat or mats having grooved finishing elements provided at the rear of the tiller assembly to provide the final snow surface conditioning by smoothing or, alternatively, to provide a "corduroy" texture to the surface of the tilled snow.

Currently, snow tillers can be provided as multisection tillers (with various subassemblies), which typically operate in a "floating" mode or in a "locked" mode. In the floating mode, each independent tiller subassembly is permitted to float over the snow surface so that it can change orientation corresponding to the terrain. In the locked mode, each tiller subassembly is mechanically locked into a particular orientation.

Because of differing snow conditions, the desired for particular snow profiles, and the presence of obstacles (particularly in low snow conditions), present day tillers have been found to suffer serious disadvantages. For example, it is sometimes desirable to create concave and convex snow profiles to create moguls and tubes on a ski slope. Unfortunately, when the tiller subassemblies of prior art tillers are locked into position to provide a desired snow profile, they are unable to move away from obstacles and become much more vulnerable to damage and can produce degraded profiles. Also, the locked profiles cannot accommodate the natural contours of the slope. So, instead of forming the desired contour in the snow surface, the surface may become gouged or otherwise unacceptable due to the inflexibility of the tiller. Additionally, the weight of the vehicle and the weight of the tiller tend to flatten the terrain.

Therefore, there is a need for a more flexible assembly in which the contour of the tiller can be selectively adjusted and controlled. There is also a need for an assembly that provides the operator with selective control of the snow tiller to vary the desired groomed profile.

SUMMARY OF THE INVENTION

An aspect of this invention is to provide a tiller provided with tiller subassemblies that can be operated in a "floating" mode or in a releasable "locked" mode. The releasable locked mode function can selectively allow, under certain conditions, the tiller subassemblies to enter a "floating" mode to reduce the possibility of damage to the tiller and then return the "released" tiller subassembly to its preselected orientation to provide a more consistent snow profile.

Another aspect of this invention provides a tiller with tiller subassemblies that can be configured in a variety of orientations in the releasable "locked" mode to create a corresponding variety of snow profiles.

A further aspect of this invention can provide variations of electrical control systems for adjusting the relative orientation of the tiller subassemblies to provide and maintain the profile selected by the operator, both manually and automatically.

An additional aspect of this invention comprises a simple hydraulic arrangement for adjusting the tiller, which can reduce manufacturing and maintenance costs.

Embodiments of this invention provide a snow tiller device adapted to be pulled by a power source comprising a multisection tiller assembly having a plurality of tiller subassemblies and tiller elements. A positioning mechanism selectively positions the tiller subassemblies relative to one another. A controller coupled to the positioning mechanism selectively maintains the desired positioning to enable the operator to create a variety of snow profiles according to conditions and intended use. Maintenance of the profile can be accomplished manually or automatically.

The invention can also include the combination of a selectively controlled tiller with a vehicle.

The method of controlling the tiller profile including selectively positioning the tiller subassemblies and controlling the positioning is also encompassed by the invention.

It is to be understood that the invention described herein can be varied in a number of ways and is not restricted to the particular embodiments described herein. The invention is intended to generally include a variety of equipment arrangements wherein the relative orientation of two or more tiller subassemblies or tiller elements can be selectively set and controlled to form a variety of different profiles.

BRIEF DESCRIPTION OF THE DRAWINGS

The invention will be described in greater detail in conjunction with the following drawings wherein:

FIG. 4B is a partial enlarged schematic view of a portion of FIG. 4A in accordance with another embodiment of the profile control element;

DETAILED DESCRIPTION OF EMBODIMENTS OF THE INVENTION

The invention is described with particular reference to a snow groomer including a snow tiller. The detailed description of the snow groomer is provided for purposes of illustration only and is not intended to be a limiting embodiment.

Figure 1:
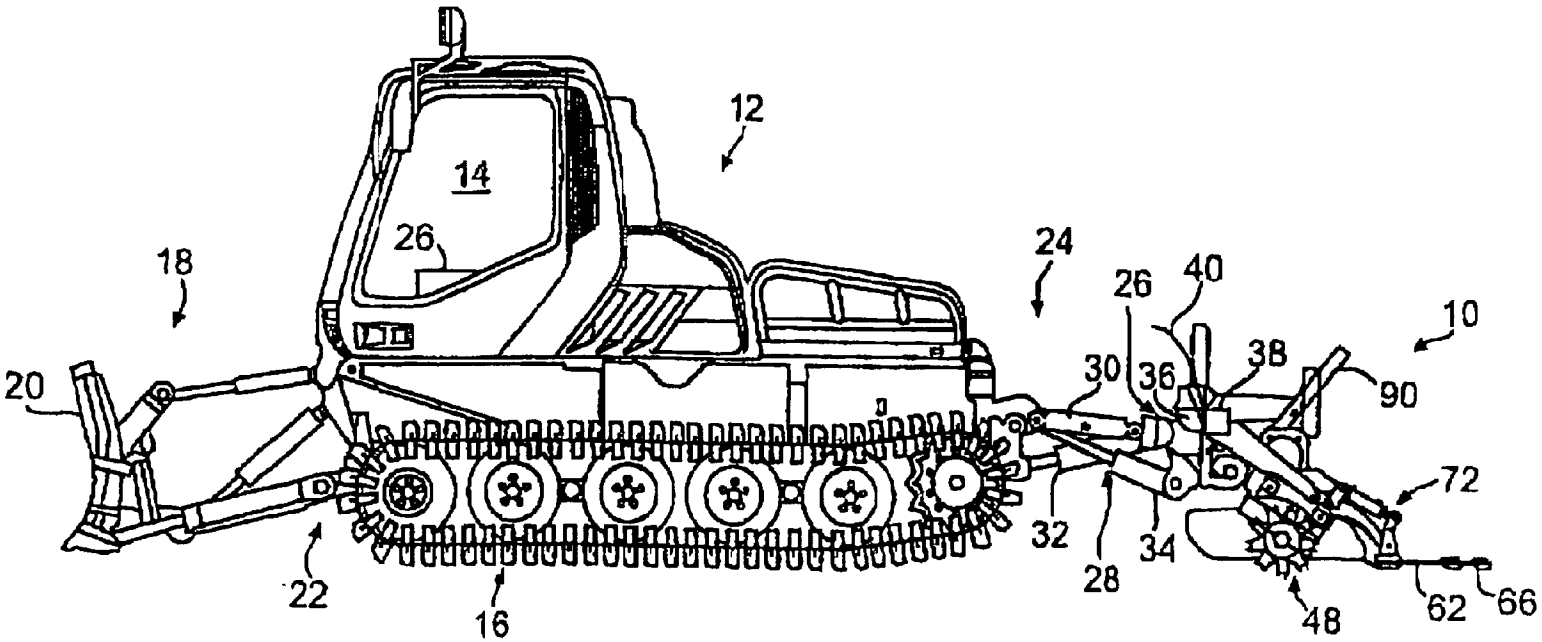
FIG. 1 is a side view of a tiller in accordance with an embodiment of the invention attached to a tracked vehicle that provides both electrical and mechanical power to the tiller.

FIG. 1 shows a ground working vehicle including a tiller 10, in accordance with an embodiment of the invention, attached to a power source, in this case a tracked vehicle 12. Vehicle 12 has a cab 14, in which an operator can sit and drive the vehicle and operate the controls for the various implements connected to the vehicle. The drive mechanism for vehicle 12 is a pair of rotatable tracks 16 with a track 16 disposed on each side of the vehicle body. Vehicle 12 has a front implement 18, in this case a hydraulically controlled plow 20, and a rear implement, which in this case is tiller 10. Vehicle 12 is especially adapted for driving on snow, but of course could be any type of vehicle. Additionally, a variety of accessories and attachments may be used with the vehicle either on the front or rear, including for example a front digger rather than a front plow or only a rear implement.

Vehicle 12 is equipped with appropriate attachment mechanisms 22 and 24 on the front and/or back of the vehicle, respectively, to provide power and structural connections to such front and/or rear implements. Cab 14 includes a control panel 26 connected to a controller, shown schematically in FIG. 1, to control operations of the vehicle and its implements. Of course, if desired or if a different type of vehicle is used, control panel 26 could be provided elsewhere on the vehicle, on the tiller itself, and at multiple locations. The control panel 26 can be of any known form suitable for actuating the implements and selecting various functions for the implements. The controller can be implemented in any known type of operating control system. For example, the control logic could be hard wired into the central logic system of the vehicle or implemented as a plug-in or through software installation.

Attachment mechanism 24 is an articulated joint for connecting tiller 10 to a power source, in this case vehicle 12, and can be a three point hitch 26 and a hydraulically controlled lifting mechanism 28. The hydraulic lifting mechanism 28 includes a main tow bar 30 and a driven hydraulic cylinder 32 that can be controlled to raise tiller 10 from the surface of the ground. A hydraulic tilt cylinder 34 is provided to change the depth at which tiller 10 works the surface. Any other suitable connecting mechanism could also be employed and could optionally include the lifting mechanism, if desired. Other desired connections could be used including electric, pneumatic, optical or communication connections to control and operate different operating functions of the tiller.

Figure 2:
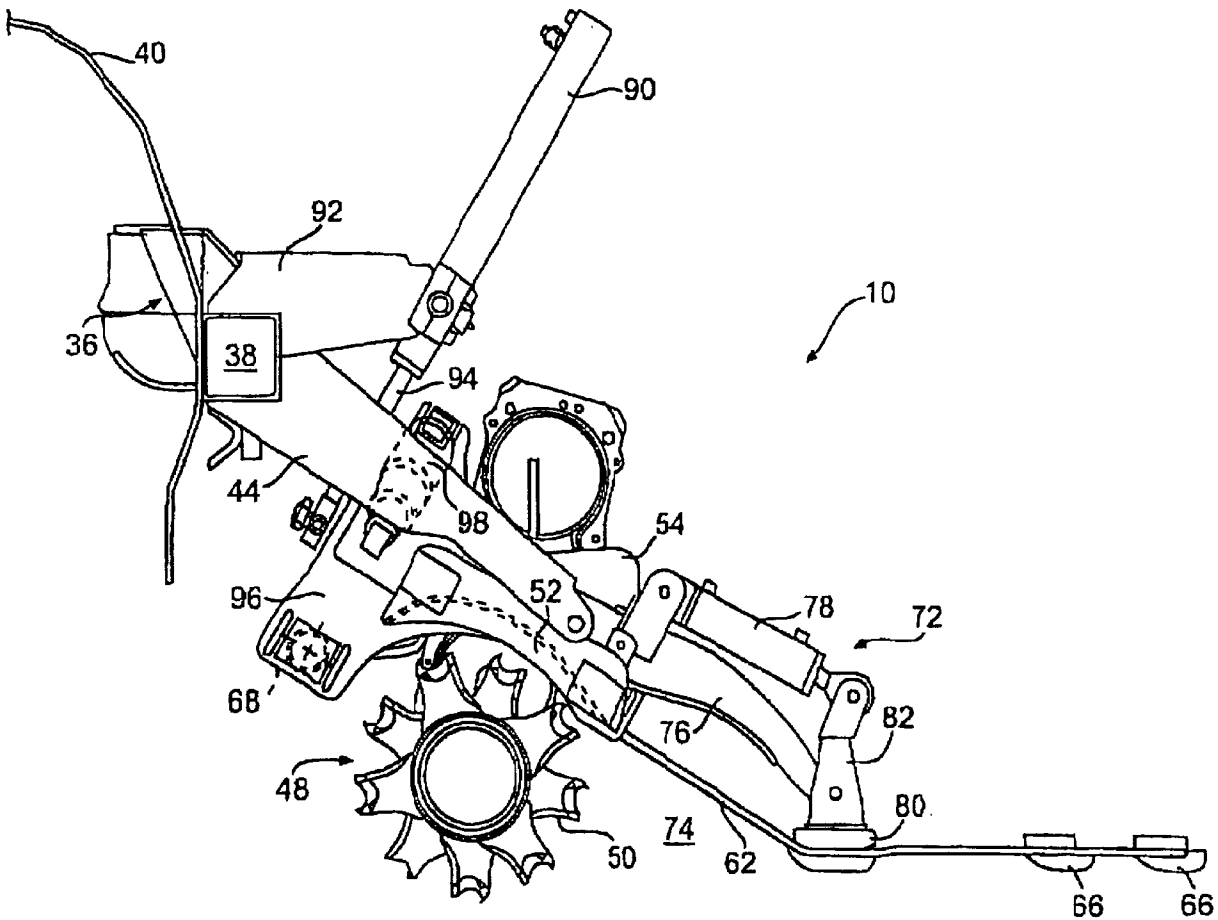
FIG. 2 is a side view in partial section of the tiller in accordance with an embodiment of the invention.

Referring also to FIGS. 2 and 4, tiller 10 includes a support frame 36 connected to the lifting mechanism 28. The support frame 36 has a main horizontal frame 38 in the form of a box beam, I beam, channel beam or any strong structural beam type number. An upper snow guard, shown as two separate panels 40 and 42, is attached to main frame 38 to capture any snow that may be blown or thrown outwardly during the grooming process. The snow guard assists in holding snow adjacent to the tiller for grinding. A pair of cross beams 44 and 46 extend rearwardly from main frame 38 and support a ground shaping element 48. Ground shaping element 48 includes a rotatable drum 50 with cutting teeth and a cover 52. Cover 52 creates a housing for rotatable cutting drum 50. Ground shaping element 48 has a longitudinal axis about which drum 50 rotates and is oriented perpendicular to a direction in which tiller 10 is driven. A drive train, represented by gear box 54, is connected to rotatable drum 50 to selectively rotate drum 50 to grind or otherwise shape the ground or material beneath drum 50. Drum 50 rotates to break up ice chunks, hard pack, or other undersirable types of snow, or ice as the case may be, to produce a softer, more desirable surface.

Ground shaping element 48 is divided into subassemblies, preferably two subassemblies 56 and 58 connected at the center by an articulated joint 60. Each subassembly includes a section of rotatable drum 50. Each subassembly 56, 58 is separately supported by main frame by cross beams 44 and 46, respectively. By this, each subassembly 56, 58 can independently pivot about its support. Support rails 68 and 70 extend to the outer ends of each subassembly 56, 58 from a pivoted connection at articulated joint 60 thereby supporting subassemblies 56 and 58, respectively, along their longitudinal axis. This arrangement creates a balanced support so that when tiller 10 is lifted from the surface of the snow, subassemblies 56, 58 do not hang from the center point of the tiller but, rather, remain level when in the float mode. Cover 52 can form a single housing or a series of housings along the length of ground shaping element 48.

In this configuration, articulated joint 60 is disposed at gear box 54 and can either be formed by gear box 54 with each subassembly 56 and 58 connected thereto or by a separate joint 60 aligned with gear box 54. It is also possible to locate the gear box spaced from the articulated joint or to use a different driving arrangement in which no gear box is used. Thus, articulated joint 60 is intended to encompass the elements located in or at the joint area in which subassemblies 56 and 58 bend with respect to each other. This joint area may or may not include gear box 54 and preferably includes the ends of each subassembly 56 and 58. This joint area also includes any brackets extending therefrom. Because each subassembly is supported by its own cross rail, the subassemblies can tilt with respect to each other when pressure is applied at articulated joint 60.

Extending from cover 52 of ground shaping element 48 is a finishing element 62. Finishing element 62 is a flexible mat, for example a rubber or heavy polymeric sheet, that is positioned to drag behind ground shaping element 48. The design, surface, and weight of the mat as it being drawn across the surface, smoothes the ground out behind ground shaping element 48 after the ground has been cut or shaped. The outer edge 64 of finishing element 62 can be shaped, for example with serration, and/or can include finishing formations 66, which are blocks or strips attached to the lower surface of or molded into the flexible mat, both of which create texture in the finished surface when tiller 10 is driven across the surface of the ground.

Finishing element 62 may also be formed as a board or membrane that does or does not have rows of finishing elements, generally formed of steel, fiberglass, or other suitable materials in a variety of profiles. It is preferred that the trailing mat be flexible at anticipated operating temperatures so that it may more closely follow the contour of the surface of the ground.

Figures 4A, 4B, 4C:
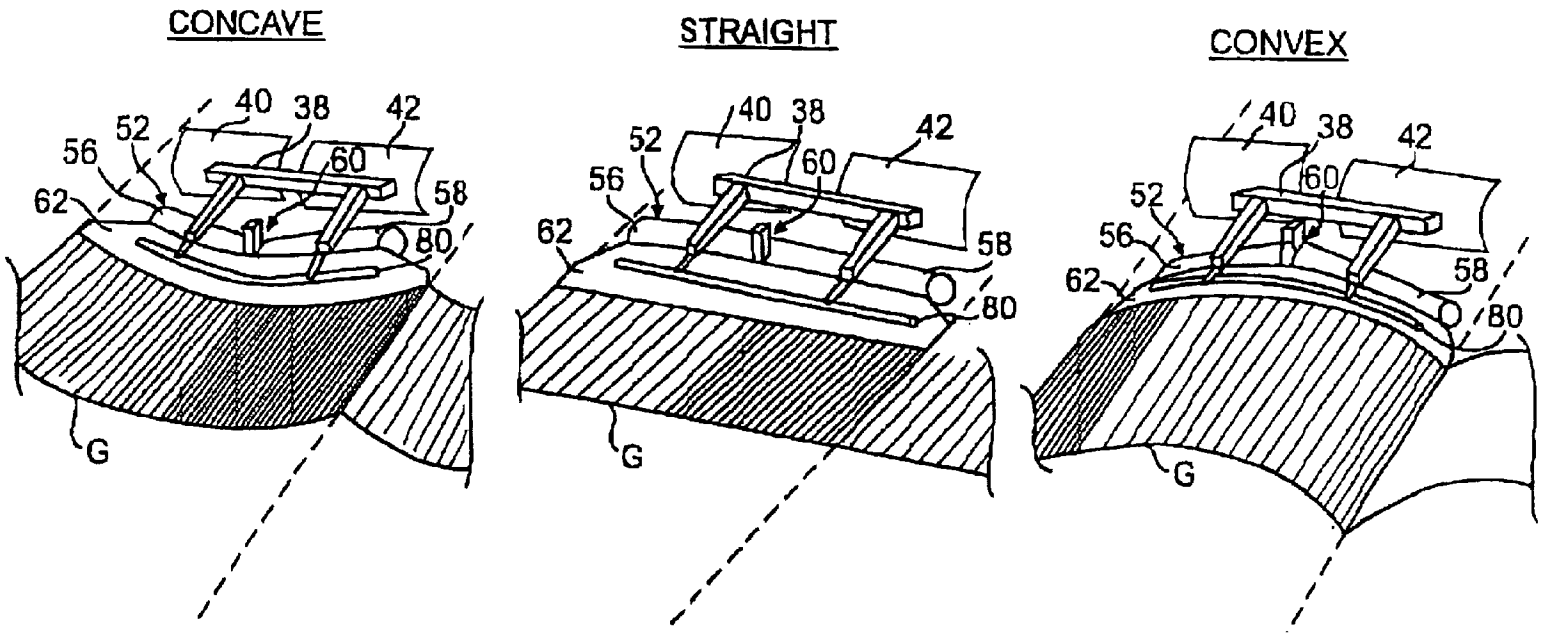
FIG. 4A is a schematic rear perspective view of the tiller in accordance with the invention forming a concave profile.
FIG. 4B is a schematic rear perspective view of the tiller in accordance with the invention forming a neutral or straight profile.
FIG. 4C is a schematic rear perspective view of the tiller in accordance with the invention forming a convex profile.

The texture in the snow surface is known as a "corduroy" surface, especially in the snow grooming field, and includes a series of striations formed on the surface of the snow. FIGS. 4A–4C show an example of a textured ground surface G formed by finishing element 62. The texture can be varied, of course, by varying the type and/or shape of edge 64 of finishing element 62 and/or the shape, type and size of finishing formations 66.

Figure 3:
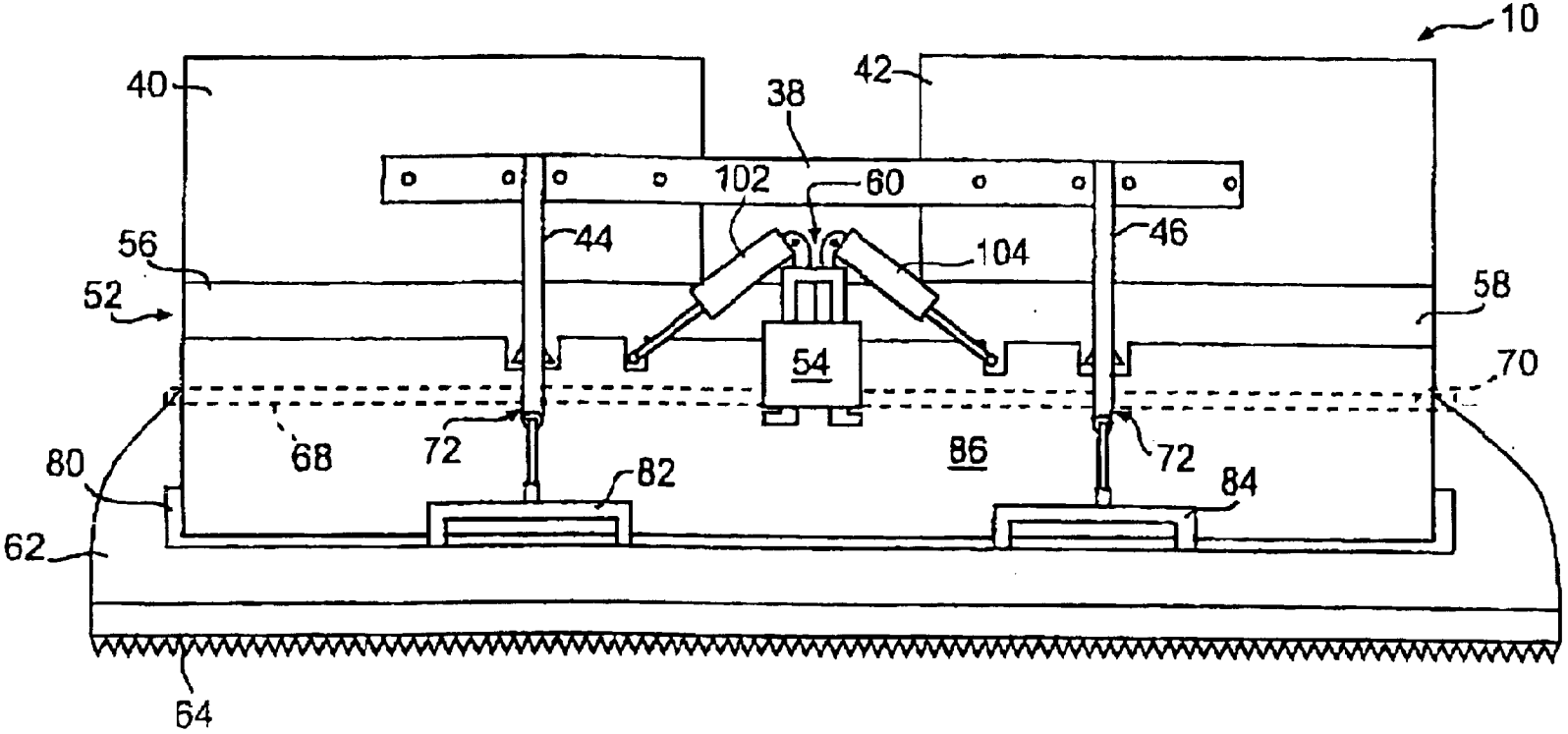
FIG. 3 is a rear view of an embodiment of the invention.

A finisher tilting mechanism 72 is provided to rotate finishing element 62 relative to the ground and to adjust the shape of finishing element 62 so as to control the volume of the snow chamber 74 formed between rotating drum 50, cover 52 and finishing element 62, as seen in FIG. 2. Preferably two finishing tilting mechanisms 72 are provided on each side of tiller 10. However, there is no specific number of mechanisms required, and any number from one or more than two is possible. Finisher tilting mechanism 72 includes a support bar 76 and a hydraulic piston 78 that is selectively actuable. Finisher tilting mechanism 72 extends from cover 52, or as an extension of cross beams 44 and 46, and is secured to finishing element 62 by a smoothing board 80, as seen in FIGS. 2 and 4A–4C, by support brackets 82 and 84. Smoothing board 80 is selectively tilted by tilting mechanism 72 to adjust snow chamber 74. A cover 86, as seen in FIG. 3, may be provided to shield finishing element 62 for aesthetic purposes.

A profile control element is provided adjacent to the articulated joint 60. In the first embodiment, profile control element is a single element 90 disposed generally perpendicular to the longitudinal axis of ground shaping element 48. As seen in FIG. 2, profile control element 90 is a driven rod, preferably a hydraulic cylinder or piston. Hydraulics are preferred because the cylinder is controllable and easily adjustable, can be automatically actuated and disabled, and provides a relief mechanism for automatically releasing when obstacles are encountered during tilling. However, any driving mechanism that can apply a force to ground shaping element 48 could be used, including, for example, a gear driven rod or ratchet assembly, pneumatic cylinders, motor driven devices or rotating devices, used singly or in combination.

Figure 4D:
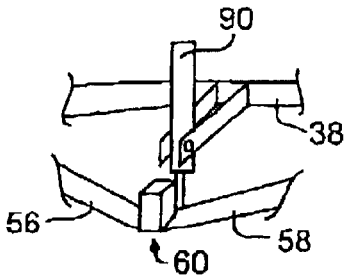
FIG. 4D is a partial enlarged schematic view of a portion of FIG. 4A in accordance with one embodiment of the profile control element.

As seen in FIG. 2, profile control element 90 is supported by a bracket 90 extending from main frame 38. The driven rod 94 is supported by bracket 96 to articulated joint 60, specifically gear box 54. Driven rod 94 can be attached to any point of articulated joint 60 and even to ends of subassemblies 56 and 58. Profile control element 90 is connected to the controller in communication with control panel 26 by conventional signal communication methods. FIG. 4D also shows the connection between profile control element 90 and articulated joint 60. A pair of shock absorbers 98 can also be provided on cover 52.

Alternatively, the profile control element can be used in place of the shock absorbers 98. In this case as seen in FIG. 3 and 4E, profile control element 100 is disposed at articulated joint 60, for example on gear box 54 or on a bracket extending therefrom, and comprises a pair of hydraulic cylinders 102 and 104 extending to cover 52 of each subassembly 56 and 58 and connected to the controller as described above.

In operation, profile control element 90 or 100 is actuated to drive its piston toward ground shaping element 48 to effect a change in orientation of ground shaping element 48 with respect to the surface of the ground. For example, profile control element 90 extends its piston toward the ground by applying a force to articulated joint 60 thereby raising the ends of ground shaping element 48 upwardly with respect to the center where articulated joint 60 is positioned. Such movement results in a concave snow profile as seen in FIGS. 4A and 4D. By retracting its piston, profile control element 90 lowers the ends of ground shaping element 48 with respect to articulated joint 60 to effect a convex snow profile, as seen in FIG. 4C. The movement is relative and can be accomplished by moving either the ends or the articulated joint or both.

FIG. 4B shows a neutral or flat profile in which the profile control element is disabled and tiller 10 is allowed to "flat" or follow the terrain. In this case, shock absorbers 98 or some other biasing mechanism accommodate irregularities in the terrain and allow tiller 10 to float over the surface.

Figure 4E:
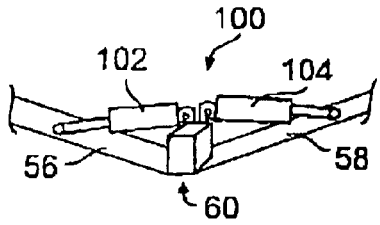

Similarly, profile control element 100 is actuated to drive each piston of cylinder 102 and 104 to retract the driving rods and raise the ends of ground shaping element 48 with respect to articulated joint 60, as seen in FIGS. 4A and 4E. The driving rods are extended to lower the ends of ground shaping element 48 with respect to articulated joint 60, as seen in FIG. 4C. Again, the movement is relative. By applying a force at or near articulated joint 60, drum 50 and cover 52 tilt thereby flexing finishing element 62. Thus, it is not necessary to provide finishing element 62 in multiple parts. In fact, the flexure of finishing element 62 provides a smoothly finished and curved surface to the worked ground. Cylinders 102 and 104 are preferably controlled simultaneously with a common control system. A hydraulic supply line can be provided with a splitter valve. Of course, separate controls could be provided if desired.

Figure 5A:
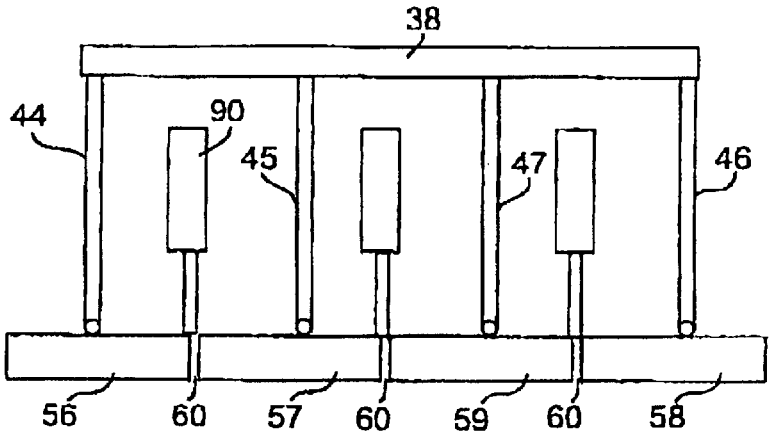
FIG. 5A is a schematic view of an alternative embodiment of the tiller in accordance with this invention in a neutral position.
Figure 5B:
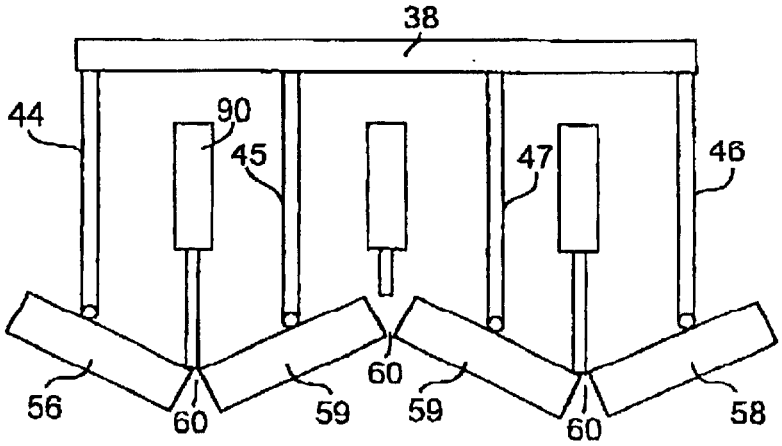
FIG. 5B is a schematic view of an alternative embodiment of the tiller in accordance with this invention in a flexed position showing a compound curve profile.

Additional profile control elements could be used to form compound curved profiles. In that case, more than two subassemblies could be provided. Referring to FIG. 5A, four subassemblies are shown 56–59 with three articulated joints 60 and three profile control elements 90. Each subassembly 56–59 is independently supported from main frame 38 by its own cross beam 44–47 and can pivot thereabout as described above. As seen in FIG. 5B, the profile control elements 90 are selectively driven to adjust the tiller profile into a compound curve. It will be understood that any number of subassemblies or combinations could be used.

Also, while the profile control element shown in FIGS. 5A and 5B is similar to that shown in FIG. 2, the embodiment of FIG. 3 could also be used alone or in combination with the profile control element 100 of FIG. 2. Further, the control system could be a single control scheme or individually controlled schemes depending on the desired flexibility of the system.

Each profile control element 90 or 100 is connected to a control system that communicates with control panel 26. By this, an operator can actuate the system and select the desired profile from within cab 14. As discussed below, each system includes a relief mechanism to accommodate irregularities in terrain and allows tiller 10 to automatically react to obstacles to prevent damage to tiller 10, which would occur if ground shaping element 48 was locked in place. Several different control schemes are possible as described below. Each system below is a hydraulic control circuit. However, other methods of control are conceivable within the scope of the invention and can be modified to suit the particular profile control element. For example, an electric logic circuit may be implemented for a mechanically driven element.

Figure 6:
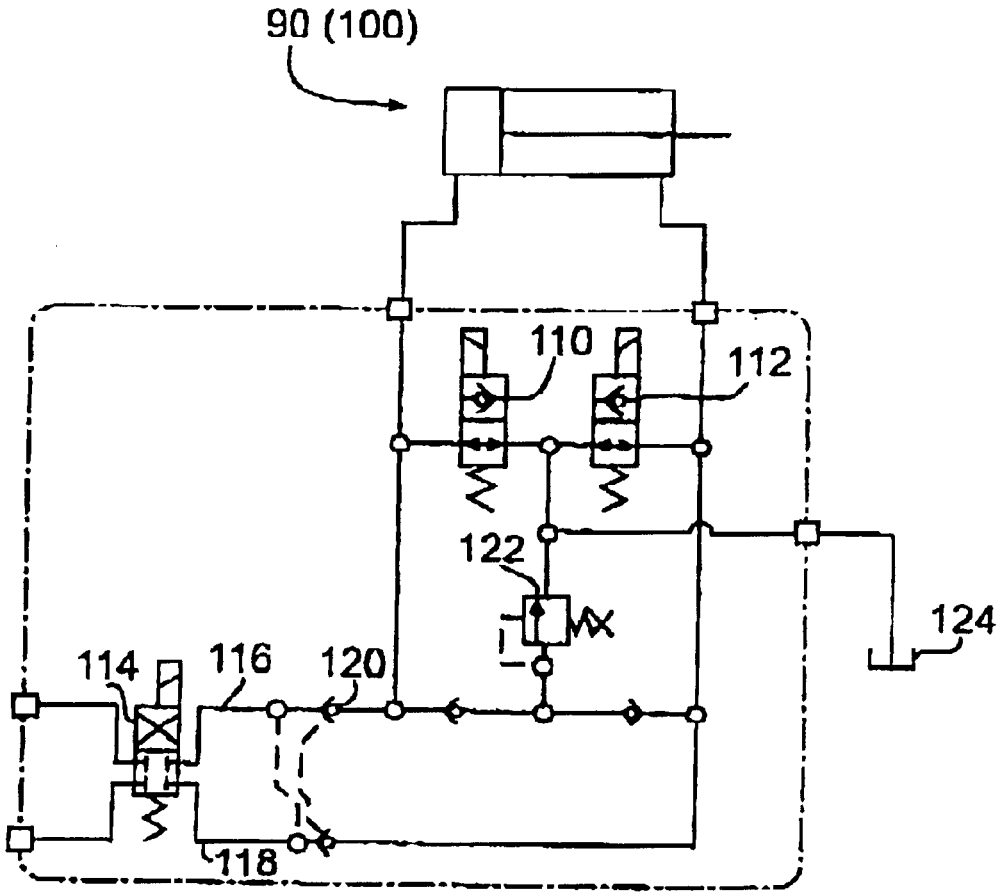
FIG. 6 is a hydraulic circuit diagram in accordance with a first embodiment of the control system.

The first control system is shown in FIG. 6, which is a hydraulic circuit that allows the tiller profile to be manually adjusted by the operator. In this scheme, the system is energized by a two position ON switch on control panel 26. When the ON switch is activated, valves 110 and 112 are energized, which enables profile control element 90 and locks the hydraulic cylinder. When the profile control system is not enabled, valves 110 and 112 are not energized, and tiller 10 is free to follow the terrain in the float mode. In this scheme, the profile control system is disabled by turning the entire system off. However, if desired, the ON switch could be modified to include an OFF mode as well, which would allow selective disablement of the system.

Once the system is enabled, a profile is selected by a three position momentary switch, which can energize several hydraulic systems including valve 114. The three position switch is positioned on control panel 26 and includes UP (convex), NEUTRAL, and DOWN (concave). For example, if UP is selected, hydraulic fluid is provided to line 118 to hydraulic cylinder 90, and if DOWN is selected hydraulic fluid is provided to line 116 to the other side of hydraulic cylinder 90. Lock valves 120 are provided to lock the piston in place during operation. The degree of concavity or convexity can be adjusted by manipulating the momentary switch. To completely reset the system, the system is turned off to disable or deenergize valves 110 and 112 to allow tiller 10 to float on the ground surface.

If an obstacle is encountered, which would apply pressure to the profile control element and thus increase pressure within the system, relief valve 122 allows hydraulic fluid to be released to tank 124 to alleviate the excess pressure. Relief valve 122 can be set at a predetermined pressure. If relief valve 122 is actuated, the profile must be manually reset.

Optionally, a position sensor can be provided in tiller 10 to supply feed back to the operator regarding position. Such a sensor could be a linear potentiometer within the profile control element. Feedback could be provided as a display or even a warning on control panel 26. Also, manual relief valve 122 could be replaced by an electro-proportional relief valve.

Figure 7:
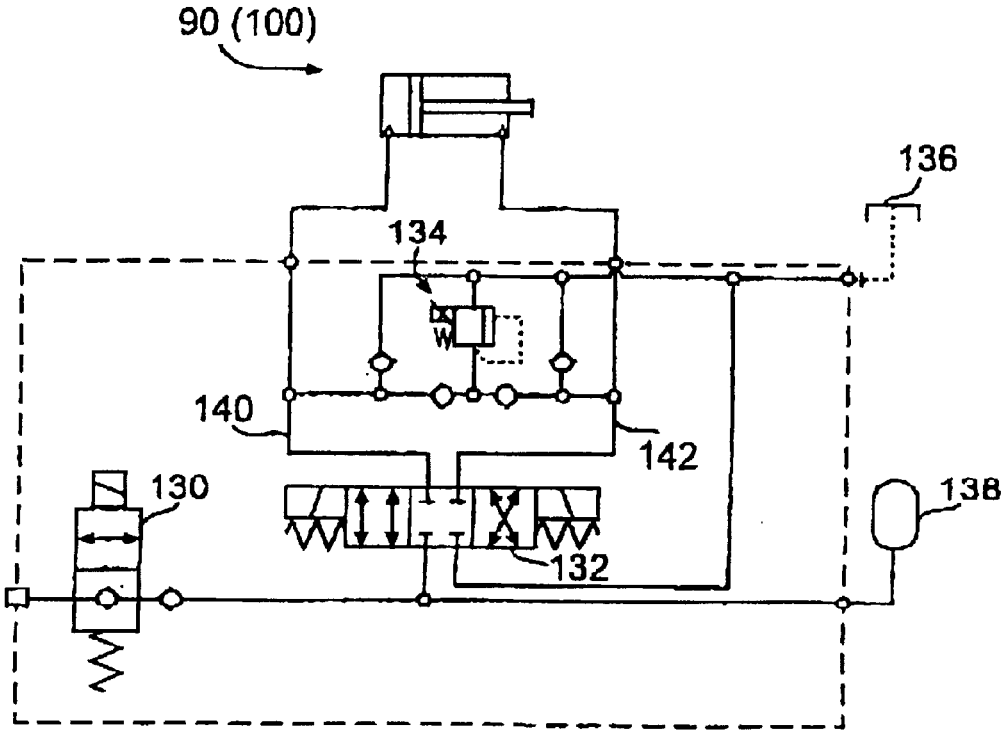
FIG. 7 is a hydraulic circuit diagram in accordance with a second embodiment of the control system.

Another control system is shown by the hydraulic scheme in FIG. 7, which is also manually adjustable but includes a memory function. The system has an ON/OFF switch on control panel 26. The position is selected using a three permanent position switch on control panel 26 to actuate valve 132. Valve 132 is normally closed, and in its neutral position it is locked to block both parts of the hydraulic cylinder. Excess pressure is accommodated by relief valve 134, which can be manual or electric. For example, a knob can be provided to set a desired relief pressure. A potentiometer can also be coupled to relief valve 134 to set a predetermined position that actuates relief valve 134. The OFF switch cuts power to relief valve 134 so that pressure is zero, which allows the hydraulic fluid to drain to tank 136. This circuit runs off the existing hydraulic circuitry.

Once the position is selected, valve 130 is actuated by a momentary switch on control panel 26 to charge the system with pressure. An accumulator 138 maintains pressure within the system. Depending on the selected position, hydraulic fluid will be supplied to line 140 (down) or 142 (up) to charge either side of profile control element 90 to apply force to tiller 10 to change its profile. In this arrangement, irregularities in the terrain will be accommodated by accumulator 138. By this, the selected profile will be returned if tiller 10 encounters an obstacle and changes position. It is also possible to recharge pressure in the system by manipulating the momentary switch, if desired. Additionally, a sensor can be provided in profile control element 90 to provide feedback to the operator to control positioning. The sensor could be electric, optical, or merely a simple mechanical sensor in the form of a graduated rod extending from the hydraulic cylinder to visually indicate the position of the cylinder.

Figure 8:
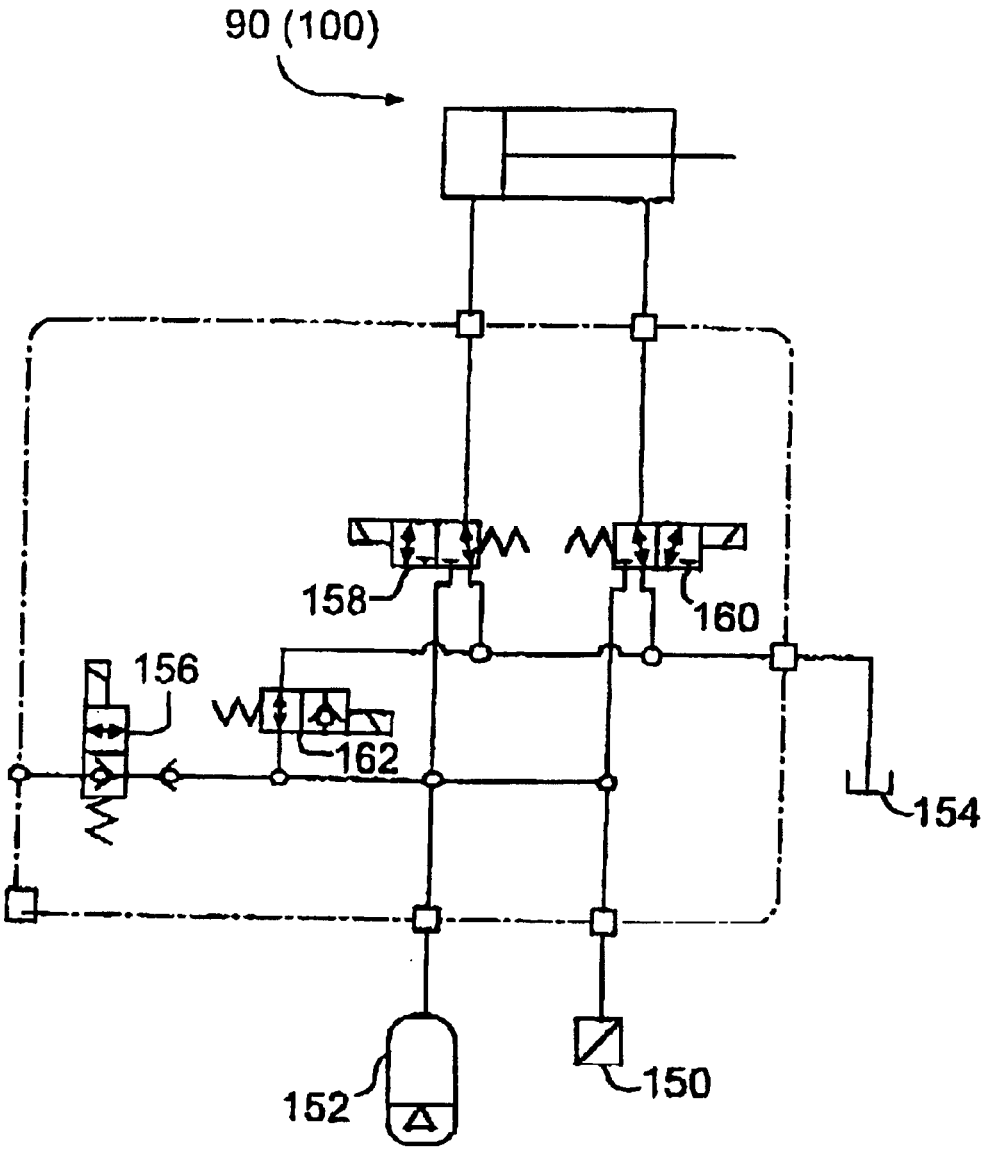
FIG. 8 is a hydraulic circuit diagram in accordance with a third embodiment of the control system.

FIG. 8 shows a fully automatic control system controlled by an onboard computer preprogrammed to adjust based on sensed conditions. The onboard computer can be any type of processor, including a conventional microprocessor. Of course, any suitable control program could be used, including a programmable system if desired. A two position switch is provided on control panel 26 to energize the system and actuate the controller. In this case, a pressure sensor 150 is provided to sense pressure within the system and a linear potentiometer is positioned within profile control element 90 to provide feedback as to the position of the movable cylinder. An accumulator 152 pressurizes the end of the movable rod and allows excess hydraulic fluid to bleed to tank 154. The hydraulic system is an electrically controlled closed loop that operates based on input signals to adjust the flow of hydraulic fluid to the hydraulic control cylinders to either maintain the desired position or to enter the release mode.

In operation, valve 156 is actuated to charge pressure by the controller. Valves 158 and 160 are selectively energized by the controller based on the position selected by the operator, by way of a switch. A valve 162 is energized to relieve pressure in the system. Valve 162 can be an electrically controlled pressure relief valve or a pulse valve controlled to selectively relieve pressure if desired. As can be seen, operation of this system can be fully automated to move tiller 10 into the selected profile and accommodate obstacles and return to the selected position.

The system automatically adjusts by establishing a required pressure and moving the cylinder through a series of set points to reach the desired value. The required pressure is calculated by calculating a slope representative of the difference in the set point signal and the feedback signal of the actual pressure. To ensure a smooth transition to the desired profile, the difference in pressure when the cylinder is in the neutral range and the required pressure for a selected profile is modulated. For example, when UP is selected, the pressure in the charge valve is modulated, and when DOWN is selected, the pressure in the relief valve is modulated. The modulation is represented by a linear change from the required pressure to no or neutral pressure and vice versa. Then, the required pressure is used to pulse either the charge valve or relief valve. As the required pressure increases, the modulated signal remains constant within the charge pressure valve, then falls off linearly, again remains constant within the neutral range of the cylinder, increases linearly within the relief valve and then remains constant within the relief valve. By this, a smooth transition between positions is accomplished ad the system can automatically modulate itself during position changes. The tiller can also be operated in a full "floating" mode in which it will generally track the existing snow profile.

Of course, if profile control element 100 were employed with any of the above schemes, the UP/DOWN switching would be adjusted according. Further, any of the disclosed sensors and other above features could be used in the various schemes to adjust cost and the degree of automation and control desired.

A tiller designed and controlled in accordance with any of the above schemes can be used to groom surfaces, for example, ski trails in controlled profiles, rather than just a float mode, as it conventional. Such a tiller also accommodates obstacles by providing a locked position that automatically responds to the terrain if necessary and, according to some embodiments, can return to its locked position. Further, this system can adjust the tiller profile to account for the weight of the vehicle and the compaction of the ground surface. By this, different profiles can easily be provided by merely driving the power source, in this case a snow grooming vehicle, across the surface of the ground to be groomed. Further, utilizing a number of relatively small free-floating tiller subassemblies would permit the grooming of complex profiles such as mogul fields to a degree not possible with present tillers. It is possible to groom a slope from convex to flat and then to concave using this device, which could not previously be done with known locking tillers.

In addition to the profile adjustments, the tiller may be provided with a range of other adjustments to address differing snow conditions on the same hill on the same day in different areas. Preferably, the operator would be able to activate all of the controls to move the various cylinders or make other adjustments to the operation of the tiller from the security of the cab. It is possible to arrange the system so that an operator would only need to glance in the year view mirror to discern if the correct quantity and quality of snow is being left behind.

It is to be understand that the essence of the present invention is not confined to the particular embodiments described herein but extends to other similar devices that employ and control the positioning of tiller subassemblies to obtain desired snow profiles.

What is claimed:

1. A tiller assembly comprising:

a main frame connectable to a drive source;

a ground shaping element carried by the mainframe, the ground shaping element divided into two subassemblies connected at an articulated joint, the subassemblies having a common longitudinal axis;

a hydraulic unit coupled to the articulated joint perpendicular to the common longitudinal axis, the hydraulic unit having a movable end;

a controller in communication with the hydraulic unit that controls movement of the hydraulic unit to effect a change in profile of a lower edge of the ground shaping element by simultaneously changing the orientation of the two subassemblies of the ground shaping element.

2. The tiller assembly of claim 1, wherein the hydraulic unit is supported by the main frame and has the movable end connected to the ground shaping element adjacent to the articulated joint.

3. The tiller assembly of claim 2, wherein the ground shaping element further comprises a gear box adjacent to the articulated joint for driving the ground shaping element, the movable end of the hydraulic unit being connected to the gear box.

4. The tiller assembly of claim 1, wherein there are two subassemblies and a single hydraulic unit.

5. The tiller assembly of claim 1, wherein the ground shaping element comprises more than two subassemblies and more than one articulated joint, and wherein there are a plurality of hydraulic units, each hydraulic unit supported on the main frame adjacent to each articulated joint.

6. The tiller assembly of claim 1, further comprising a lifting mechanism connected to the main frame that lifts the ground shaping element from the ground surface.

7. The tiller assembly of claim 1, wherein the tiller assembly is a snow tiller and the ground shaping element is a rotatable drum with a cover, and the assembly further includes a flexible finishing mat supported by the cover so as to form a snow chamber in the space between the rotatable drum, cover, flexible mat and the ground.

8. The tiller assembly of claim 1, wherein the controller includes a hydraulic system connected to the hydraulic unit including a relief mechanism that releases pressure from the system to allow the ground shaping element to automatically respond to obstacles encountered on the ground.

9. A snow groomer comprising:

a frame with an operator platform, the operator platform comprising an enclosed cab;

a drive unit supported by the frame;

a ground engaging assembly supported by the frame and driven by the drive unit, the ground engaging assembly comprising a rotating track; and the tiller assembly of claim 1.

10. A tiller assembly comprising:

a main frame connectable to a drive source;

a ground shaping element carried by the main frame, the ground shaping element comprising a gear box, a first subassembly connected to the gear box at a first articulated joint, and a second subassembly connected to the gear box at a second articulated joint;

a first hydraulic unit connected to the gear box and to the first subassembly; and a second hydraulic unit connected to the gear box and to the second subassembly, the first hydraulic unit and the second hydraulic unit controllable by at least one controller to control their movements to effect a change in a profile of a lower edge of the ground shaping element.

11. The ground working vehicle of claim 10, wherein the hydraulic units are substantially aligned with a longitudinal axis of the ground shaping element and extend outwardly from a central point adjacent to the gear box.

12. The tiller assembly of claim 11, further comprising a lifting mechanism connected to the main frame that lifts the ground shaping element from the ground surface.

13. The tiller assembly of claim 10, wherein the tiller assembly is a snow tiller and the ground shaping element is a rotatable drum with a cover, and the assembly further includes a flexible finishing mat supported by the cover so as to form a snow chamber in the space between the rotatable drum, cover, flexible mat and the ground.

14. The tiller assembly of claim 10, wherein the controller includes a hydraulic system connected to the hydraulic unit including a relief mechanism that releases pressure from the system to allow the ground shaping element to automatically respond to obstacles encountered on the ground.

15. A snow groomer comprising:

a frame with an operator platform, the operator platform comprising an enclosed cab;

a drive unit supported by the frame;

a ground engaging assembly supported by the frame and driven by the drive unit, the ground engaging assembly comprising a rotating track; and the tiller assembly of claim 10.

* * * * *